United States Patent [19]

Bode

[11] Patent Number: 4,787,600

[45] Date of Patent: Nov. 29, 1988

[54] TRANSMISSION JACK ATTACHMENT

[75] Inventor: Dale A. Bode, Ochelata, Okla.

[73] Assignee: American Industrials Group, Tulsa, Okla.

[21] Appl. No.: 84,676

[22] Filed: Aug. 12, 1987

[51] Int. Cl.[4] ..... B66F 3/00

[52] U.S. Cl. ..... 254/126; 254/134

[58] Field of Search ..... 414/11; 187/8.43; 269/45, 296, 17; 254/122, 126, DIG. 4, 2 R, 2 B, 2 C, 7 R, 7 B, 7 C, 8 R, 8 B, 8 C, 3 R, 3 B, 3 C, 133, 134, DIG. 16

[56] References Cited

U.S. PATENT DOCUMENTS

| | | | |
|---|---|---|---|
| 568,543 | 9/1896 | Parks | 269/45 |
| 2,523,734 | 9/1950 | Stephenson et al. | 254/2 B |
| 3,048,237 | 8/1962 | Rutherford | 187/8.43 |
| 4,025,054 | 5/1977 | Yamazaki | 254/126 |
| 4,549,722 | 10/1985 | Gagliano | 254/134 |
| 4,570,905 | 2/1986 | Gerstner | 254/134 |

FOREIGN PATENT DOCUMENTS

| | | | |
|---|---|---|---|
| 1110383 | 7/1961 | Fed. Rep. of Germany | 254/134 |

*Primary Examiner*—Robert C. Watson

*Attorney, Agent, or Firm*—Head & Johnson

[57] ABSTRACT

An attachment for supporting a heavy object, such as an automobile or truck transmission, to a mobile lifting jack of the type having a conventional, generally horizontal saddle member, the attachment being formed of a base plate attached to the saddle member in generally coplanar relationship, three independently operable, spaced apart, secondary scissor jacks each having a base supported on the base plate top surface and having a top bracket, and a load support plate having the lower surface thereof affixed to the secondary jack top brackets, the upper surface of the load support plate being adaptable to receive a heavy object, such as a transmission thereon, the height of the support plate being adjustable by the mobile lift jack as well as the secondary scissor jacks and the tilt of the load support plate being adjustable by the secondary lift jacks.

6 Claims, 4 Drawing Sheets

TRANSMISSION JACK ATTACHMENT

SUMMARY OF THE INVENTION

The present invention is directed towards an attachment for supporting a heavy load, such as automobile or truck transmission, to a mobile lifting jack of the conventional type having a generally horizontal saddle member at the top. The typical mobile lift jack is hydraulically operated, has wheels so that it can be moved about on a floor surface and has a pivoted handle which functions to guide the mobile jack. When the pivoted handle is reciprocated up and down, hydraulic fluid is used to raise and lower the saddle member attached to an arm extending upwardly from the mobile jack. This conventional type of mobile jack is frequently used to lift the frame of an automobile or truck to permit removal or installation of tires and is exceedingly convenient and effective for providing a variable height lifting force. Such types of conventional mobile lift jacks have been employed to aid in assisting the removal of heavy objects such as transmissions from cars and trucks, however, the conventional jack has certain deficiencies which make it difficult to use for this purpose.

One of the problems when removing, and particularly when reinstalling, a transmission from an automobile or truck is that in order to affix the transmission to its proper position attached to the engine of the automobile or truck the transmission must be carefully and precisely aligned with respect to the engine. This usually requires tilting of the transmission in vertical planes diagonal to each other and while a mobile lifting jack is convenient for providing height adjustment, it does not have facilities for tilting a heavy object, such as a transmission placed thereon.

The present invention provides an attachment which can be affixed to the saddle member of a conventional mobile lift jack to provide both secondary height adjustment as well as pivotation of the object supported thereon in diagonally positioned vertical planes.

The attachment is formed of a base plate which is attachable to the saddle member of a mobile lifting jack. The base plate has a top surface and a bottom surface. The bottom surface is attached to the lifting jack saddle member in generally coplanar and generally horizontal relationship.

A plurality (preferably three in number), of independently operable spaced apart secondary jacks, preferably of the scissor-type, are employed. Each of the secondary jacks has a base portion which is supported on the top surface of the base plate and each of the secondary jacks has a base portion which is supported on the top surface of the base plate and each of the secondary jacks has a top bracket. By adjusting each of the secondary jacks individually the vertical height of the top bracket with respect to the base of each jack can be independently adjustable.

A load support plate having an upper and a lower surface is employed and the lower surface thereof is pivotally affixed to each of the secondary jack top brackets so that thereby the load support plate can be varied in height both by the mobile lifting jack and by varying the height of the top brackets of the secondary jackets, and in addition, the tilt of the load support plate can be varied in perpendicular vertical planes.

The load support plate preferably has retention means, such as in the form of chains or the like attached to the upper surface to secure a load, such as a transmission, to the top surface.

Thus, the attachment when combined with a mobile lifting jack provides a means of supporting a heavy object, such as a transmission and permits the elevation or height of the object relative to a floor surface to be varied as well as the tilt of the object in perpendicular intersecting vertical planes.

For reference to other devices which have an objective similar to that of the present invention, reference may be had to the following U.S. Pat. Nos. 2,838,278, 2,747,837, 3,958,793, 3,040,908, 3,062,500, 3,028,145, 3,012,311, 4,166,608, 3,773,293, 3,559,981.

The invention will be better understood with reference to the following descriptions and claims, taken in conjunction with the attached drawing.

DESCRIPTION OF THE VIEWS

DESCRIPTION OF THE PREFERRED EMBODIMENT

Figure 1:
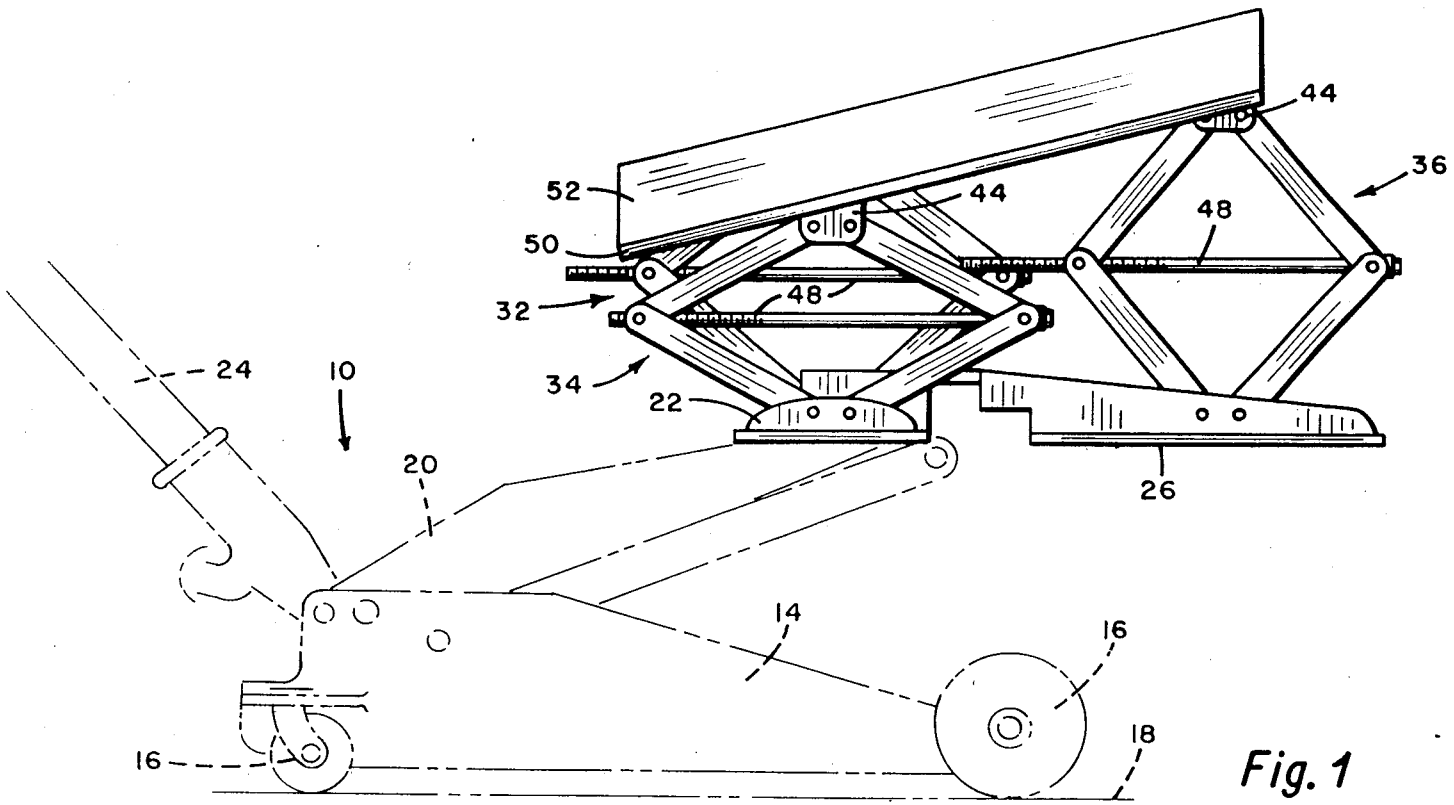
FIG. 1 is an elevational view showing a conventional mobile lift jack in dotted outline as supported on a floor surface and showing the attachment mechanism of the present invention affixed to the saddle member of the mobile lift jack.

Referring to the drawing and first to FIG. 1, a conventional mobile lift jack is generally indicated by the numeral 10. The attachment apparatus of this invention for supporting a heavy object, such as an automobile or a truck transmission is generally indicated by the numeral 12.

The mobile lift jack 10 is of a type commonly employed in garages and service stations and in automobile and truck repair shops. The mobile lift jack includes a frame 14 having wheels 16 permitting the jack to be moved about on a floor surface 18. It has a pivoted arm 20 which is raised and lowered in response to a hydraulic cylinder (not shown), the arm 20 having at the upper end thereof a generally horizontal saddle member means 22. The arm 20 is raised, thereby raising the saddle member 22, by reciprocal action of a jack handle 24 to pump fluid into the hydraulic cylinder (not shown). To lower the arm 20 the handle 24 is rotated, releasing the hydraulic fluid in the cylinder and permitting the arm to return to the position more nearly parallel to the base 14, Thus, the mobile lift jack 10 is a very useful and convenient tool for lifting objects and particularly the frames of automobiles and trucks to permit the removal and replacement of tires or wheels. The use of the mobile lift jack 10, however, for removing or installing transmissions is less effective since transmissions must be accurately and carefully aligned with the engine to which they are affixed and such is not readily permitted when a transmission is supported onto the saddle member 24. Thus, the attachment of this invention is employed in conjunction with the mobile lift jack to provide an inexpensive and yet highly effective and sturdy device for installing and removing transmissions from cars and trucks, as well as for lifting a heavy object which must be carefully aligned to be installed in their proper position.

Figure 2:
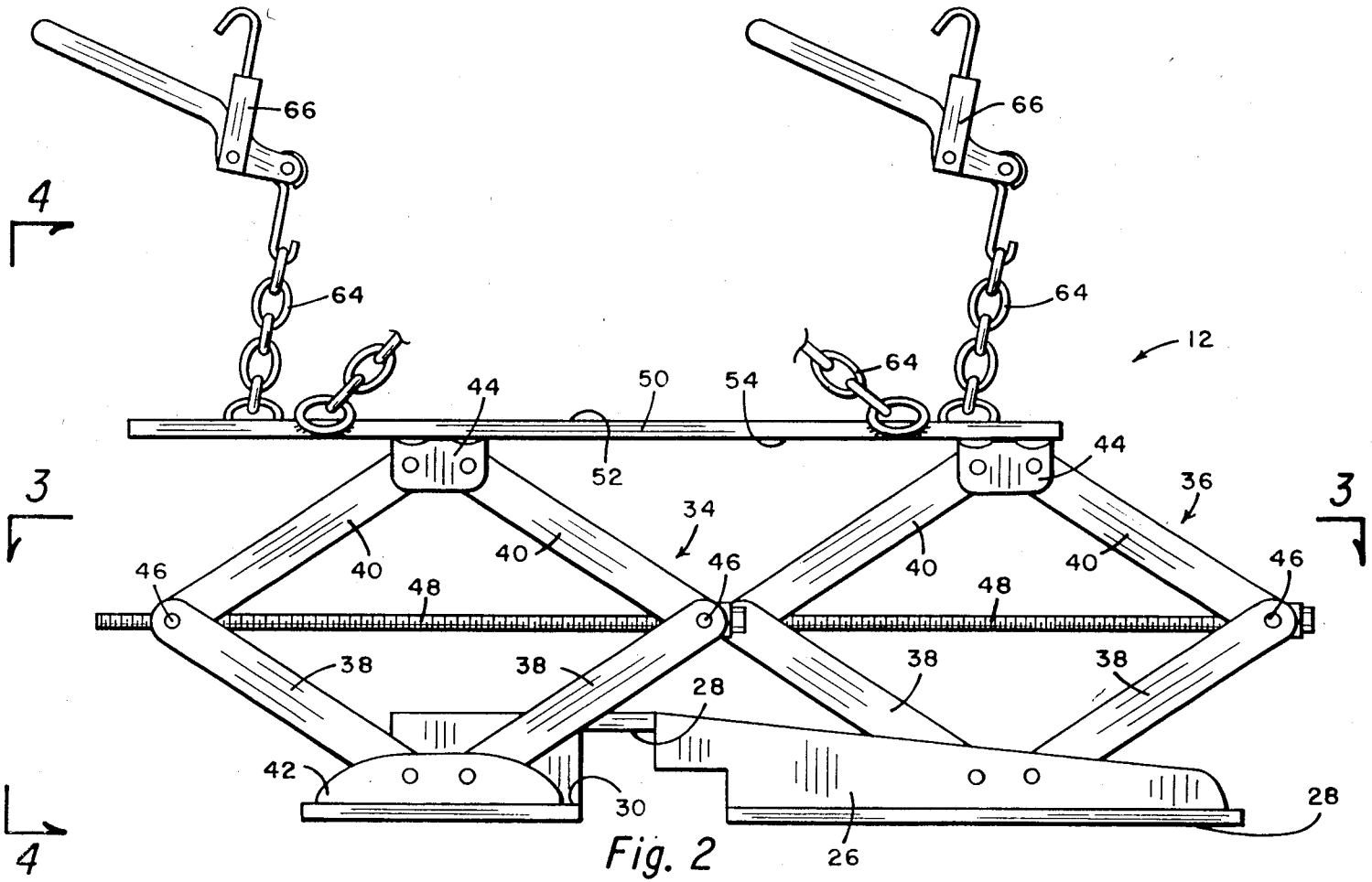
FIG. 2 is an enlarged elevational view of the attachment as shown in FIG. 1 shown in somewhat greater detail and showing the attachment adjusted so that the top load support plate is generally parallel to the base plate.

The transmission jack attachment is best shown in FIG. 2. the attachment includes a base plate 26 having a lower surface 28 and a top surface 30. The base plate lower surface 28 is affixed to the mobile jack saddle member 22 in generally coplanar and generally horizontal position. As the arm 20 for the mobile jack is moved up and down, the base plate 26 moves up and down and the base plate is retained in generally horizontal positions.

Figure 3:
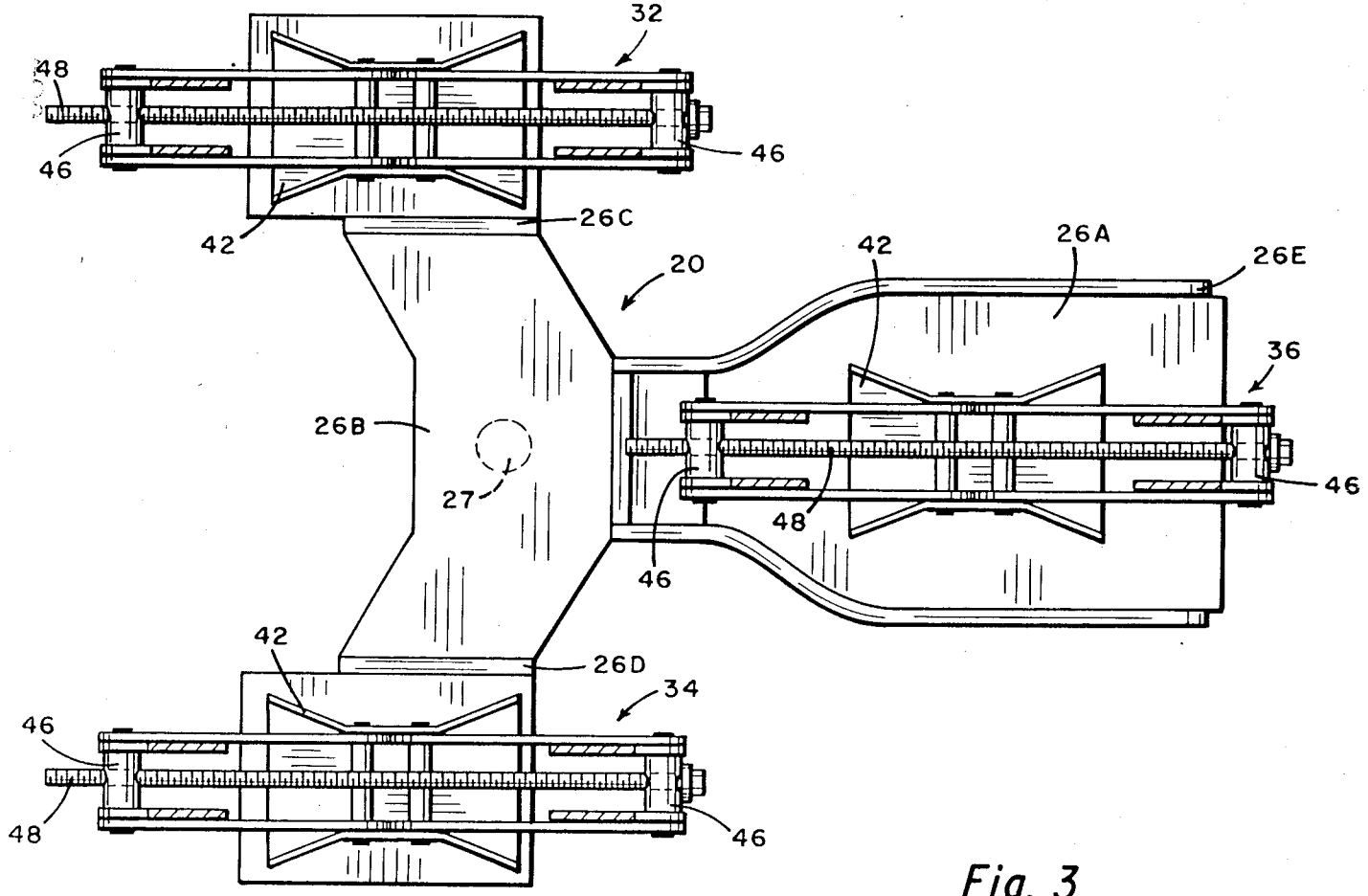
FIG. 3 is a cross-sectional view taken along the line 3—3 of FIG. 1 showing a preferred configuration of the base plate and showing more details of the secondary scissor jacks.

Supported on the base plate are three secondary jacks 32, 34 and 36. Jacks 34 and 36 are seen in FIG. 2. All three of the jacks are seen in FIG. 3. Each of the secondary jacks is of a standard scissor-type and each consist of two pair of lower legs 38 and two pairs of upper legs 40. Lower legs 38 are pivoted at their lower ends to a base 42. The upper ends of each of the lower legs 38 are pivoted to the lower ends of the upper legs 40, and the upper ends of the upper legs 40 are secured to a top bracket 44.

A pin member 46 is used to pivotally retain the upper ends of the lower legs 38 to the lower ends of the upper legs 40, all six of the pin members being seen in Figure 3. The pin members have openings therein, one pin member of each secondary jack being threaded and the opposite pin member having an unthreaded opening therein. A screw 48 is employed with each of the secondary jacks and is rotatably received in one pin member 46 and threadably received in the other pin member 46 of each jack. By rotating the screws 48, the elevational position of the top brackets 44 of each of the secondary jacks 32, 34, 36 can be varied in height relative to the jack base 42.

Affixed on the top brackets 44 of the three secondary jacks is a load support plate 50 having an upper surface 52 and a lower surface 54.

Figure 5:
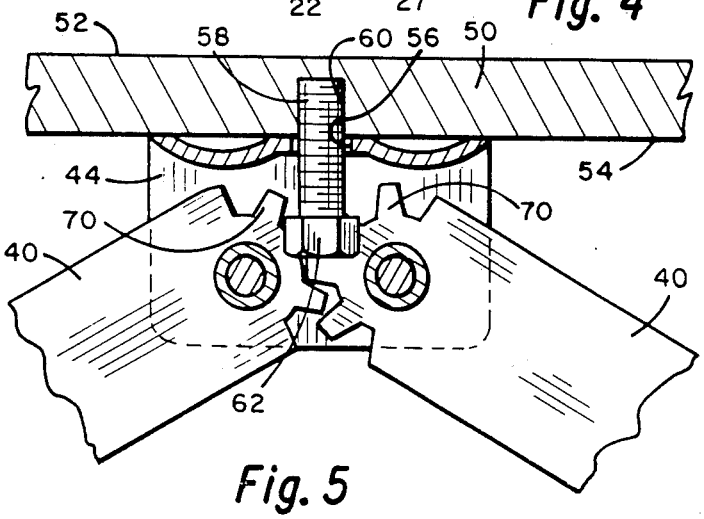
FIG. 5 is a fragmentary cross sectional view taken along the line 5—5 of FIG. 4 and showing details of the secondary scissor jacks and showing the means of attachment of the top bracket of the scissor jack to the load support plate.

As shown in FIG. 5, each of the top brackets 44 has an opening 56 therein. Each top bracket opening 56 receives a bolt 58 which is threaded into a threaded recess 60 in the bottom 54 of the load support plate 50. Bolt 58 has a head 62 and the bolt is of sufficient length so that when properly threaded into the recess 60 the head is spaced away from the bottom surface of the horizontal portion of brackets 42 so that each of the brackets 42 can pivot relative to the load support plate bottom surface 54.

Figure 4:
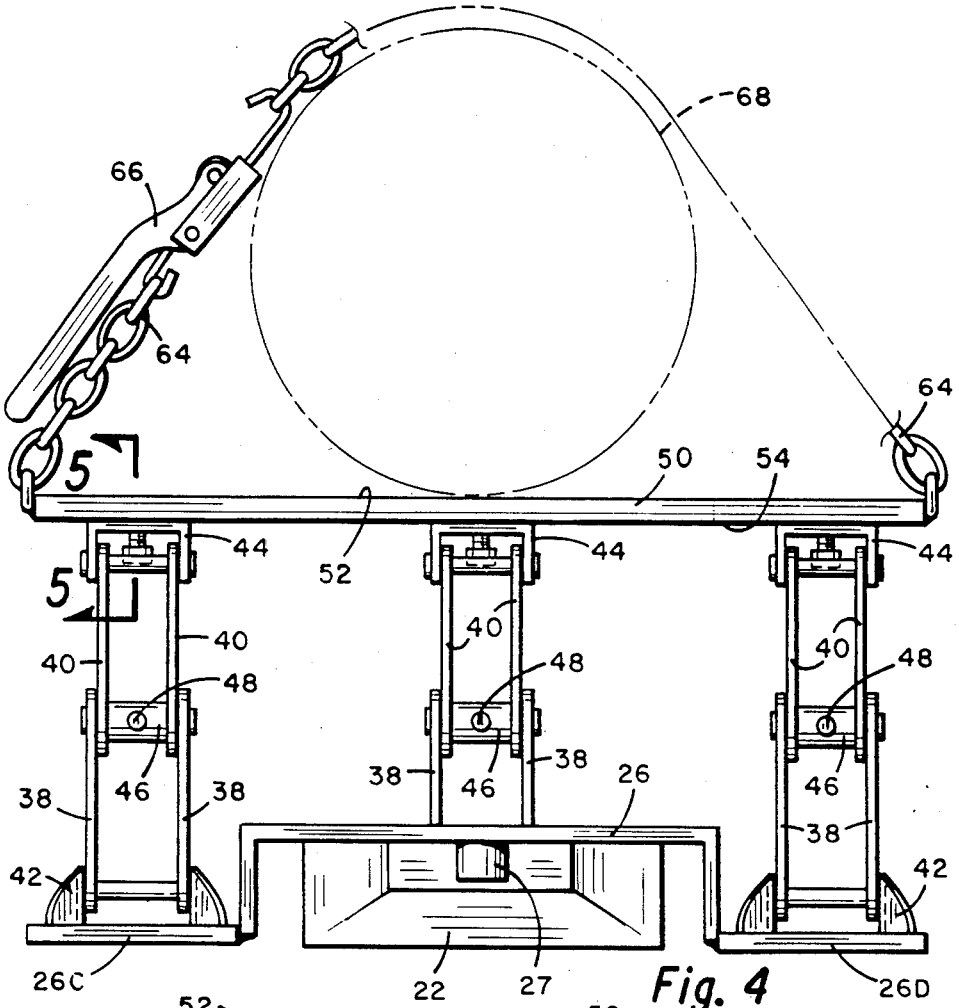
FIG. 4 is a cross-sectional view taken along the line 4—4 of FIG. 2 showing an elevational view of the attachment and showing an object, representative of a transmission, in general spherical dotted outline as supported on the top surface of the load support plate of the attachment.

As shown in FIGS. 2 and 4, the load support plate 50 is preferably provided with load retention means, such as chain 64 and toggle action clamps 66 so that a heavy load, such as a transmission 68 emblematically represented in FIG. 4, can be secured to the load support plate top surface 52.

The base plate 26 is preferably of a generally T-shaped configuration as shown best in FIG. 3. This T-shaped configuration provides a post portion 26A and a cross-bar portion 26B. The secondary jacks 32 and 34 are positioned at opposite ends of the cross-bar portion 26B and the secondary jack 36 is positioned adjacent the end of the post portion 26A. Thus, the secondary jacks are positioned such that imaginary lines drawn to interconnect the top brackets 42 form a delta. This preferred orientation allows the load support plate 50 to be easily adjustable so that any load supported on the load support plates can be carefully and accurately oriented both as to its elevational position; that is, its height above floor surface 18, as well as its orientation in perpendicularly intersecting vertical planes to permit a transmission to be easily and accurately oriented to the engine to which it is being removed or to which it is being attached. FIG. 1 shows the inclination of the load support plate 50 relative to the horizontal.

In addition to the preferred T-shaped arrangement, the base plate 26 is also configured with step down portions at the outer ends for mounting the secondary jacks 32, 34, and 36 thereon. By the employment of these step down portions, the total minimum height of the load support plate 50 relative to a mobile lift jack saddle member 22 is reduced. The step down portions at the outer end of the T-shaped base plate cross-bar portion 26B are indicated by the numerals 26C and 26D, and a step down portion of the base plate at the outer end of the T-shaped base is indicated by the numeral 26C.

Referring again to FIG. 5, it can be seen that the upper ends of the secondary jack upper legs 40 are provided with teeth 70 which mesh with each other. This helps to maintain each top bracket 44 in a generally horizontal relationship relative to each jack base portion 42.

The preferred embodiment as described provides an inexpensive and yet very sturdy and effective attachment for employment with a conventional mobile lift jack to permit the easy support of a heavy object, such as a transmission, and to support such object so that the height can be very accurately adjusted both by the lift jack and by the secondary jacks, and in addition the tilt in intersecting vertical planes can be accurately adjusted so that a transmission can be easily and accurately aligned into position for removal from or attachment to an engine.

The claims in the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. An attachment for supporting a heavy object, such as an automobile or truck transmission, to a mobile lifting jack of the type having a conventional, generally horizontal saddle member means, the saddle member means being elevationally positionable by operation of the lifting jack, comprising:

a base plate means having a bottom surface attachable to a mobile lifting jack saddle member means in generally coplanar relationship therewith and having a top surface:

a plurality of independently operable spaced apart secondary jacks (means) each having a base supported on said base plate means top surface and each having a top bracket means, the vertical spacing between said base and said top bracket means of each secondary jacks (means) being independently adjustable; and a load support plate means having an upper surface and a lower surface, said (tip) top bracket means of each of said secondary jack means being secured to said load support plate lower surface, said top surface of said load support plate being adaptable to receive a heavy object, such as a transmission(,) thereon, said load support plate being elevationally positional by operation of either one or both of the mobile lifting jack and said secondary jacks.

2. An attachment for supporting a heavy object as in claim 1 wherein said plurality of independently operable secondary jacks is three secondary jacks spaced such that lines drawn between adjacent of said top brackets means would form generally a delta configuration.

3. An attachment for supporting a heavy object as in claim 1 wherein each of said secondary jacks is a scissor jack.

4. An attachment for supporting a heavy object as in claim 1 wherein each said secondary jack top bracket means is pivotally attached to the bottom of said load support plate means.

5. An attachment for supporting a heavy object as in claim 2 wherein said base plate means is generally T-shaped in configuration having post and cross-bar portions and wherein said secondary jacks are positioned adjacent the ends of said post and cross-bar portions.

6. An attachment for supporting a heavy object as in claim 1 including retention means secured to said upper surface of said load support plate for securing an object to said load support plate.

* * * * *